US006430749B1

(12) United States Patent
Waheed

(10) Patent No.: US 6,430,749 B1
(45) Date of Patent: Aug. 13, 2002

(54) RESTRAINT DEVICE COVER JACKET

(76) Inventor: Keith N. Waheed, P.O. Box 520222, Miami, FL (US) 33152

( * ) Notice: Subject to any disclaimer, the term of this patent is extended or adjusted under 35 U.S.C. 154(b) by 0 days.

(21) Appl. No.: 09/877,876

(22) Filed: Jun. 11, 2001

(51) Int. Cl.[7] ..... A41D 1/02
(52) U.S. Cl. ..... 2/108; 128/869
(58) Field of Search ..... 2/108, 69, 69.5, 2/75, 85, 93–96, 114, 115, 106, 80, 83, 247; 128/873, 874, 846, 869; 297/464, 465

(56) References Cited

U.S. PATENT DOCUMENTS

| | | | | | |
|---|---|---|---|---|---|
| 3,742,519 | A | * | 7/1973 | Wiley | 2/114 |
| 3,901,229 | A | * | 8/1975 | Hensel et al. | 128/873 |
| 5,228,140 | A | * | 7/1993 | Baustin | 2/247 |
| 5,926,845 | A | | 7/1999 | Troyer | |
| 5,946,722 | A | | 9/1999 | Trautmann | |
| 6,024,091 | A | * | 2/2000 | Bennett | 128/873 |
| 6,119,270 | A | | 9/2000 | Chou | |
| 6,212,684 | B1 | * | 4/2001 | Waheed | 128/873 |

FOREIGN PATENT DOCUMENTS

| | | |
|---|---|---|
| FR | 2552639 | 4/1985 |

* cited by examiner

*Primary Examiner*—Gloria M. Hale
*Assistant Examiner*—Tejash Patel
(74) *Attorney, Agent, or Firm*—Stephen R. Greiner

(57) ABSTRACT

A restraint device cover jacket used for the covering, concealment, and hiding of handcuffs and/or wrist shackles when used in conjunction with a wrap around waist handcuff retaining belt/chain. The "restraint device cover jacket" includes a body, a right sleeve ending at the wrist of a wearer; a left sleeve ending at the wrist of a wearer. The "cover jacket" also includes a right pocket opening or hand entry slit that leads to a false pocket; and a left pocket opening or hand entry slit that leads to a false pocket. When the left and right hands are placed into the corresponding pocket openings the hands meet in front of the wearer (behind the front panel) where they can be binded together with a pair of handcuffs and attached to a waist chain/belt. On the bottom of the rear panel there is a left side handcuff retaining belt-guide loop and a right side handcuff retaining belt-guide loop that conceals and anchors the handcuff retaining belt around the waist of the wearer.

7 Claims, 2 Drawing Sheets

RESTRAINT DEVICE COVER JACKET

FIELD OF THE INVENTION

The present invention relates to an article of clothing, and in particular to an article of clothing with left and right pocket openings or hand entry slits that lead to false pockets (no pockets). The pocket openings, other than being decorative and for visual effects, gives the garment the appearance of being a conventional jacket. The left and right pocket openings in particular allows the hands to enter behind the front panel of the jacket where they can be handcuffed and attached to a handcuff retaining belt which is itself attached to the jacket by way of a belt-guide loop. The "cover jacket" completely conceals and covers the restraining devices on the wearer from the casual observer. The casual observer thinks that the wearer (prisoner) simply has his hands in his pockets.

BACKGROUND OF THE INVENTION

There are certain jobs and situations that demand and require that certain persons be restrained, such as the criminal and the mentally insane. These persons are restrained for their own protection and for the protection of society as well. There is also a need from time to time for these same restrained persons to be moved from facility to facility; from court to court; and from various other places often times using commercial carriers and other public acommodations.

According to a recent Justice Department report, the number of people held in U.S. prisons, jails, and other correctional facilities exceeded two million at the end of 1999. And many of these very same people had to be transported between correctional institutions and various courts.

A common method of restraining these persons while they are being transported from place to place is to use handcuffs which binds their wrists together for the security and restraint of the prisoner and also for the safety of those nearby. For added security and restraint a belt with a handcuff—retaining loop is often times fastened around the waist of a prisoner. When the cuffs are passed through the loop, the prisoner is effectively prevented from moving his hands, wrists, arms, and elbows more than a few inches in any one direction. Restrained in this manner with the physical restraining devices visible to the public these persons are now ready to be transported. The above described method has been used quite effectively for some time, but there are problems associated with "publicly" transporting a prisoner by means of visually exposing the hand-cuffs and retaining belt to the public.

The sight of a handcuffed person is frightening to some and may cause onlookers to panic or flee from this person's presence. A person hand-cuffed and restrained with physical restraining devices visually exposed could cause some people to be prejudiced towards a verdict of guilt before and doing court procedings. Also, the sight of a handcuffed person in transport may cause that person to seem to be inhuman, as well as be treated the same. It creates attention that neither the official escorting the prisoner nor the prisoner himself desires. Often times, because of the unwelcomed attention that visually exposed restraining devices cause, the prisoner asks the escorting official for a covering to hide such devices from public view.

Finally, because the handcuff retaining belt is not attached or anchored to anything but is only wrapped around the wearer's waist it allows the wearer to manuver his handcuffed hands to various lateral positions. By twisting and sliding the belt around the waist the wearer can move his hands from the front to either his left side or to his right side, and it is very important for the escorting official to know where the prisoner's hands are at all times. A need, therefore, exists for a product that allows and permits restraint over the prisoner and security for the public at all times, but conceals and hides said restraining devices from the casual observer and also anchors said restraining devices to the wearer by passing the belt through the handcuff belt-guide loops.

SUMMARY OF THE INVENTION

In light of the problems associated with the known methods and apparatus for transporting prisoners from place to place using commercial carriers and other public accommodations, it is a principal object of the invention to provide a cover garment having the appearance of a regular jacket with pocket "openings" (but no pockets) that will allow the wearer hands to be positioned in a manner to not interfer with the handcuffs and waist belt/chain. To all out-ward appearance and to the casual observer the wearer simply has his/her hands inserted in his/her pockets.

It is another object of the present invention to provide a garment that allows a prisoner to be securely restrained while being transported from place to place but, when employed in a court house in the presence of a judge or jury can reduce or eliminate any stigma or assumption of guilt associated with the wearing of handcuffs. In short, the garment decreases the assumption of being guilty that is often times associated with being locked down and with being presented in a court room setting shackled in handcuffs and a waist chain.

It is a further object of the invention to provide a garment that can be made in practically any size to accommodate wearers of different statures. Whatever the size, however, the garment is compact. When not in use, it may be easily carried, folded away in a piece of luggage or suspended from a hanger in a closet.

It is an additional object of the invention to provide a garment of the type described that may be easily donned or doffed with the help of an assistant. Once positioned on a wearer, however, the wearer, (whose wrists are then binded/cuffed and connected to a waist chain) being incapable of moving his arms, cannot remove the garment without the assistant's aid.

It is an additional object of the invention to provide a garment that covers and conceals the restraining devices worn by the prisoner and is comfortable to wear. The garment has no hard parts of its own that can rub against the skin of the wearer. Thus, the likelihood of injury to a wearer caused by the garment is minimal.

It is another object of the invention to provide a cover garment that does not have to be removed in order to adjust or remove the restraining devices to permit a wearer to eat or relieve himself. It is believed, then, that airlines and other public providers of services will be less likely to shun wearers of the garment from their facilitites. In order to remove or adjust the restraining devices the front panel of the jacket simply need to be lifted and adjustments to or removal of the restraining devices can be performed. This can be done whether the wearer is standing or sitting.

It is an object of the invention to provide new and improved elements and arrangements thereof in a garment being a cover jacket for the purposes described which is light weight in construction, inexpensive to manufacture, and dependable in use.

It is another object of the invention to provide a means for anchoring the handcuff retaining belt to the jacket thus anchoring the belt to the wearer disallowing the wearer to twist and slide the belt around his waist for repositioning of the hands once the restraining devices (cuffs) have been applied.

Briefly, the cover jacket in accordance with the invention achieves the intended objects by featuring a front panel and a rear panel with side-by-side parts. A zipper releasably fastens the side-by-side parts together. A pair of sleeves extend from the front and rear panels. On the front left panel and front right panel there is a pocket opening that leads to a false pocket so that when the prisoner's hands are inserted into the pocket openings they are brought together where they can then be cuffed. The left and right side seams are not stitched together (left opened, unfinished) several inches from the bottom creating a flap which allows accessibility to the restraining devices whether the prisoner is sitting or standing.

Also, on the front left panel and front right panel and adjacent to the pocket openings are handcuff belt openings/slits that allow the handcuff retaining belt to exit from underneath the jacket and wrap around the waist of the wearer. Finally, on the rear left panel and rear right panel there is a handcuff belt guide loop that attaches and anchors the handcuff retaining belt around the waist of the wearer.

The foregoing and other objects, features and advantages of the present invention will become readily apparent upon farther review of the following detailed description of the preferred embodiment as illustrated in the accompanying drawings.

BRIEF DESCRIPTION OF THE DRAWINGS

The present invention may be more readily described with reference to the accompanying drawings, in which.

DETAILED DESCRIPTION OF THE PREFERRED EMBODIMENT

Figure 1:
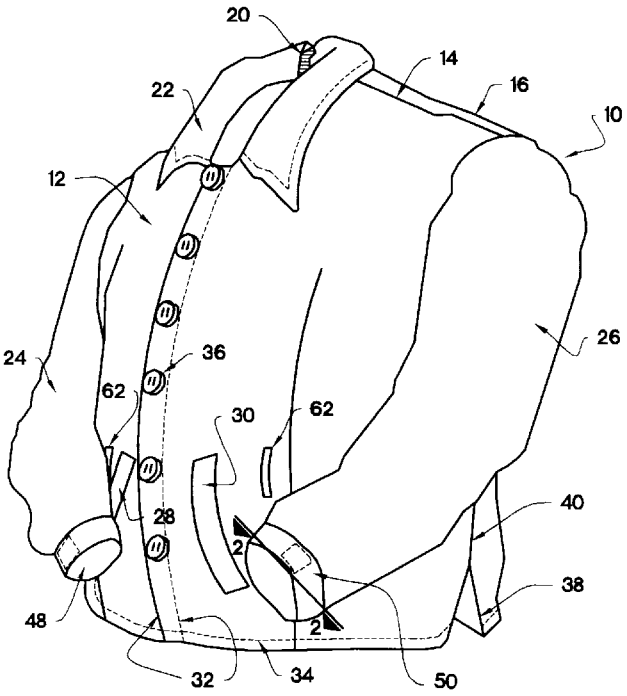
FIG. 1 is a perspective view of a cover jacket in accordance with the present invention.
Figure 2:
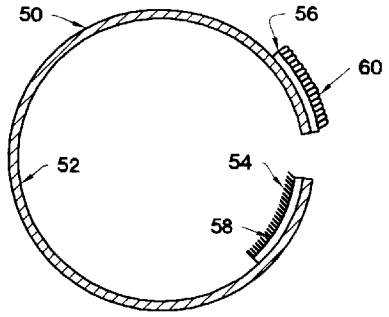
FIG. 2 is a cross section view of the cuff of the cover jacket taken along line 2—2 of FIG. 1.
Figure 3:
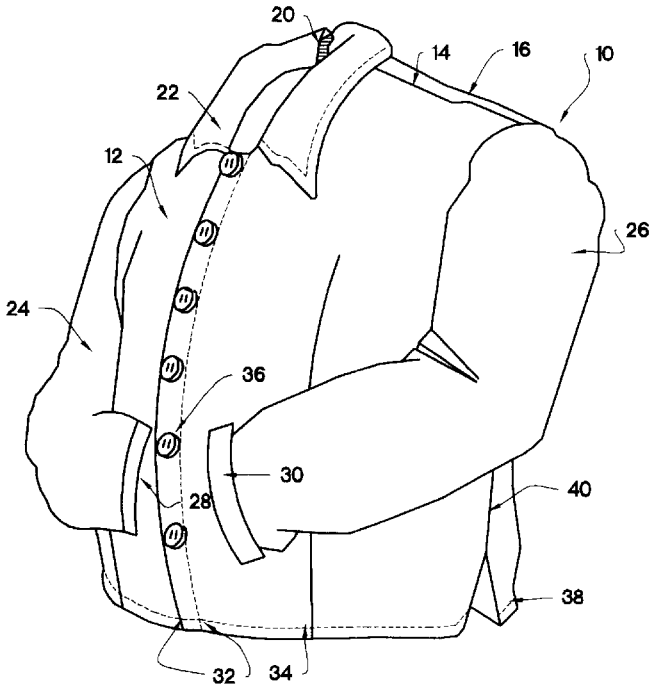
FIG. 3 is a perspective view of a cover jacket with cuffed hands inserted in pocket openings concealing the restraints from casual observers.
Figure 4:
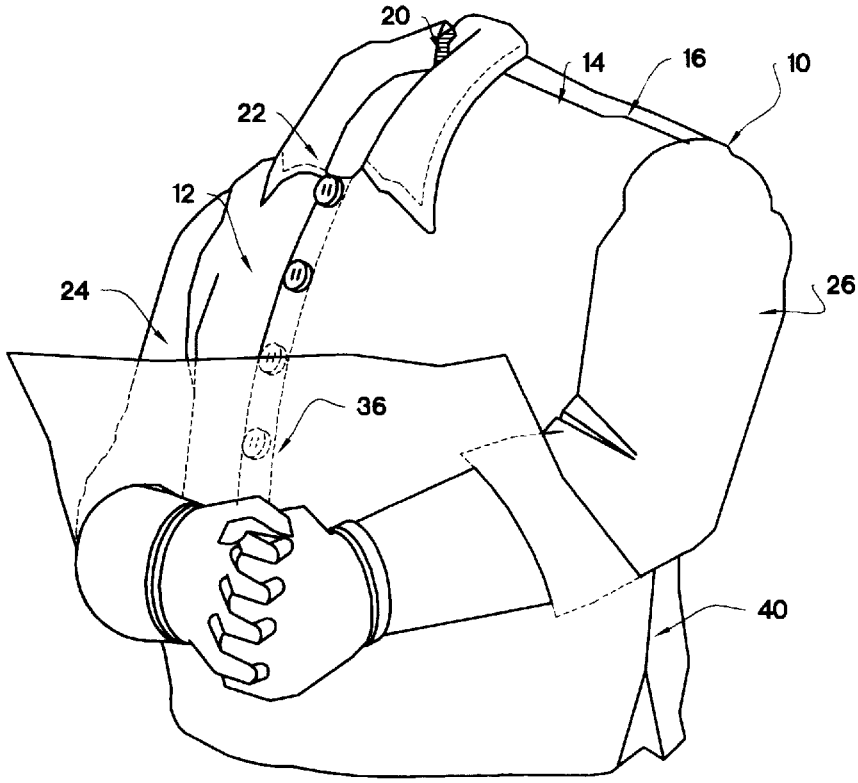
FIG. 4 is a front view of a cover jacket with front panel lifted to show how cuffed hands are positioned when attached to a waist belt/chain.
Figure 5:
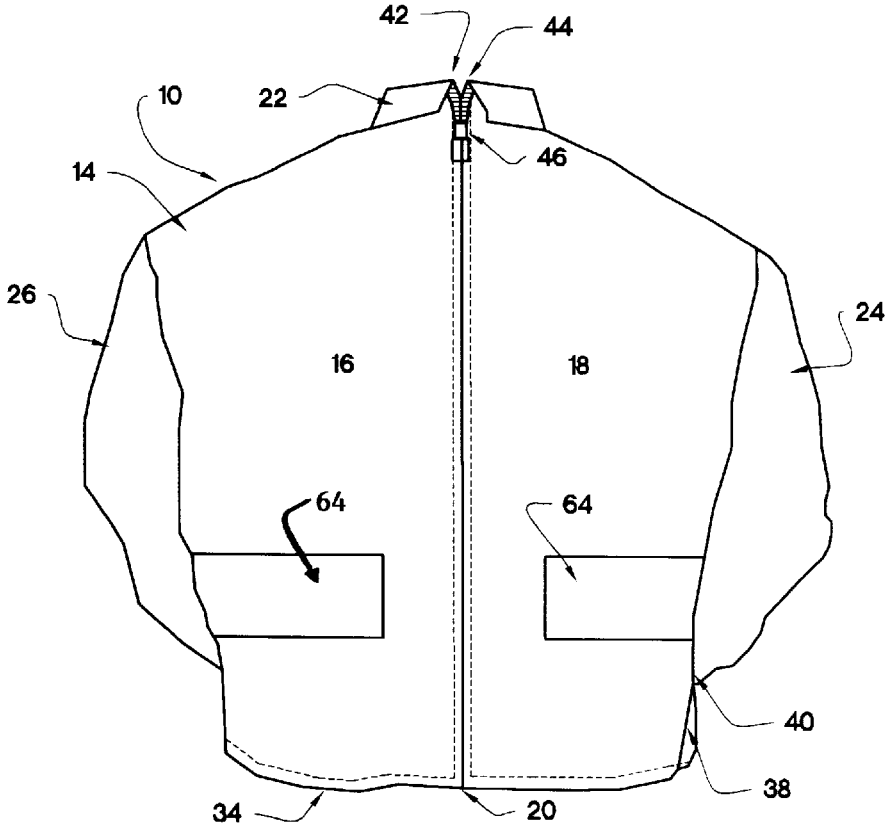
FIG. 5 is a rear view of a cover jacket.

Referring now to the FIGS., a cover jacket in accordance with the present invention is shown at 10. Cover jacket 10 includes a front panel 12 for positioning against the chest of a wearer and a rear panel 14 for positioning against the back of a wearer. Front panel 12 is disguised to look like the front of a conventional jacket. Rear panel 14 is split into side-by-side parts 16 and 18 and has a zipper 20 joining parts 16 and 18 together. A collar 22 is connected to front and back panels 12 and 14 for encircling the neck of a wearer. A pair of tubular sleeves 24 and 26 for receiving the arms of a wearer are joined to the front and back panels 12 and 14 and extend therefrom.

On the right side of front panel 12 is a pocket opening 28 into which the right hand of the wearer is inserted into a false pocket. On the left side of front panel 12 is a pocket opening 30 into which the left hand of the wearer is inserted into a false pocket. When both hands are inserted into perspective pocket openings 28 and 30 they are brought together in front of the wearer underneath the front panel 12 where they are then placed in position to be fitted with hand cuffs and attached to a waist chain.

On the right side of front panel 12 and adjacent to right pocket opening 28 is a handcuff belt entrance/exit opening 62 and on the left side of front panel 12 and adjacent to the left pocket opening 30 is a handcuff belt entrance/exit opening 62. These belt openings 62 allow the handcuff retaining belt to exit from underneath front panel 12 of the jacket and wrap around the waist of the wearer.

On the bottom of left rear panel 16 is a handcuff belt-guide loop 64 which receives the left end of the handcuff retaining belt. On the bottom of right rear panel 18 is a handcuff belt-guide loop 64 which receives the right end of the handcuff retaining belt. When both ends of the handcuff retaining belt passes through the left and right handcuff belt-guide loop 64 and are connected at the center of the rear panel 14 the belt-guide loop 64 acts as a concealer and anchorer of the handcuff belt disallowing the wearer to reposition and manuver his hands in a lateral position.

Cover jacket 10 is made from a durable fabric such as canvas. Front panel 12, back panel 14, collar 22, and sleeves 24 and 26 are cut to fit a wearer and are stitched together using conventional sewing techniques. Zipper 20 is hidden along its length by flaps formed from fabric comprising the adjacents parts 16 and 18. The resulting jacket 10 has a normal appearance, attracting minimal attention from those viewing it.

Front panel 12 has a pair of vertical seams 32 spaced about one inch (2.5 cm) apart and extending down the center of front panel 12 from its top at collar 22 to its bottom at hem 34 that simulate the opening in a conventional jacket. Between seams 32, a number of buttons 36 are stitched onto front panel 12 to simulate means for closing the opening in a conventional jacket. Besides being entry points for the hands of the wearer the false pocket openings 28 and 30 are sewn to the front panel 12 on opposite sides of seams 32 to complete the visual effect that jacket 10 is conventional in operation.

Parts 16 and 18 of rear panel 14 are sewn along their forward edges and at side seams 40 to front panel 12. The rearward edges of parts 16 and 18, however, are releasably secured to one another by the toothed fastening components 42 and 44 of zipper 20. Parts 16 and 18, being of equal size, locate zipper 20 in the center of panel 14. Fastening components 42 and 44 extend vertically downward from their tops at collar 22 to their bottom at hem 34. A slidable tab 46 permits fastening components 42 and 44 to be selectively separated so that cover jacket 10 may be donned from the rear.

Sleeves 24 and 26 are sewn about their upper ends to front and back panels 12 and 14 in a manner of a conventional jacket. Sleeves 24 and 26 terminate with cuffs 48 and 50 sewn to their lower ends. Each cuff 48 and 50 includes a fabric strip 52 formed into a semi-circle whose ends are adjacent one another. Hook and loop fasteners 54 and 56 are attached to the opposite ends of each strip 52. Fastener 54 is sewn to the inner face of strip 52 and comprises a strip of "Velcro" pile material including a dense mat of small, uncut loops 58 formed of thread. Fastener 56 however, is sewn to the outer face of strip 52 and comprises a strip of "Velcro" hook material having a plurality of transverse lines of hooks 60 spaced along its length. The ends of hooks 60 are turned inwardly so as to catch in loops 58 when fasteners 56 and 58 are pressed together into a band of adjustable size. This detailed finish of the cuffs 48 and 50 adds to the sought after look and appeal of a conventional jacket.

The use of cover jacket 10 is straight forward. First, zipper 20 is opened, parts 16 and 18 are separated, and the arms of a wearer are inserted into sleeves 24 and 26 so that his hands extend from cuffs 48 and 50. By next drawing slidable tab 46 upwardly over fastening components 42 and 44 parts 16 and 18 are connected together with the wearer inside jacket 10. Cuffs 48 and 50 are then secured against the wrists of a wearer by wrapping such around the wrists and pressing fasteners 54 and 56 together to maintain a tight fit. The wearer's right and left hands are then inserted into the perspective pocket openings 28 and 30 where the hands are then positioned to be fitted with handcuffs and if desired attached to a waist chain/belt.

From underneath the front panel 12 the left end of an unattached handcuff retaining belt is passed through the left side handcuff belt exit slit 62. The right end of an unattached handcuff retaining belt is passed through the right side handcuff belt exit slit 62. The left side and right side handcuff belt-guide loop 64 then acts as a guide to receive the handcuff retaining belt which passes through the belt-guide loops 64 and connects at the center of rear panel 14. Once the handcuff retaining belt passes through the belt guide loops 64 and is connected the belt-guide loops 64 conceals and anchors the handcuff retaining belt to the wearer.

Open finished seam 38 of left and right side seams 40 allows the bottom of panel 12 to be slightly lifted to apply, adjust or remove the restraining apparatus. This can be performed whether the prisoner is standing or sitting. Cover jacket 10 completely conceals and hides from view all restraining apparatus from the casual observer. The status of being unnoticed because the physical restraining devices are concealed or hidden from public view by jacket 10 is exactly what is desired by the escorting official and the prisoner. Also, when used in the courts, cover jacket 10 disallows jurors minds and attention to focus on the appearance of physical restraints but rather on the facts and details of the case at hand.

When use of cover jacket 10 is no longer required, it is removed from a wearer by reversing the steps outlined above. The cover jacket 10 is then folded up or hung in a closet for storage and subsequent reuse. If necessary, cover jacket 10 may be washed with known detergents in a washing machine.

While the invention has been described with a high degree of particularity, it will be appreciated by those skilled in the art that modifications may be made thereto. For example, cover jacket 10 could be made with interior pockets to accommodate body armor for protecting prisoners at risk of attack. Also, cover jacket 10 could be made with "Velcro" or snap buttons to close or secure open seams 38 of garment. Therefore, it is to be understood that the present invention is not limited to the sole embodiment described above, but emcompasses any and all embodiments within the scope of the following claims.

I claim:

1. A jacket, comprising:

a front panel including a bottom;

a rear panel joined to said front panel, said rear panel being split into side-by-side parts selectively joined together by a releasable fastener; and, a pair of tubular sleeves each having a bottom joined to, and extending from, said front panel and said rear panel for receiving the arms of a wearer; and, said front panel being provided with a first pair of openings remote from said rear panel for receiving the hands of a wearer projecting from the bottoms of said tubular sleeves, said first pair of openings being substantially adjacent with one another so that the hands of the wearer are brought into substantially close proximity with one another between said front panel and said rear panel so that handcuffs are worn thereon.

2. The jacket according to claim 1 wherein said releasable fastener is a zipper.

3. The jacket according to claim 1 wherein said front panel includes a flap at the bottom thereof that can be elevated for access to the hands of a wearer being positioned between said front panel and said rear panel, and said flap being separated from said rear panel by a pair of notches extending upwardly from the bottom of said jacket between said front panel and said rear panel.

4. The jacket according to claim 1 wherein said front panel further includes a second pair of openings located adjacent said first pair of openings for passage of a handcuff retaining belt into and through said jacket between said front panel and said rear panel, and said jacket further comprising a pair of guide loops secured to said rear panel for receiving and supporting said handcuff retaining belt.

5. A strait jacket, comprising:

a front panel for positioning against the chest of a wearer;

a rear panel joined to said front panel for positioning against the back of a wearer, said rear panel having side-by-side parts;

a zipper on said rear panel for releasably fastening together said side-by-side parts of said rear panel;

a pair of guide loops each being respectively secured to one of said side-by-side parts of said rear panel for receiving and supporting a handcuff retaining belt encircling said jacket;

a pair of tubular sleeves each having a bottom joined to and extending from said front panel and said rear panel for receiving the arms of a wearer;

said front panel being provided with a first pair of openings remote from said rear panel for receiving the hands of a wearer projecting from the bottoms of said tubular sleeves, said first pair of openings being substantially adjacent with one another so that the hands of the wearer are brought into substantially close proximity with one another between said front panel and said rear panel so that handcuffs is worn thereon; and, said front panel being provided with a second pair of openings located adjacent said first pair of openings for passage of said handcuff retaining belt into and through said jacket between said front panel and said rear panel.

6. The jacket according to claim 5 wherein said front panel includes a flap at the bottom thereof that may be elevated for access to the hands of a wearer being extended through said first pair of openings and positioned between said front panel and said rear panel, and said flap being separated from said rear panel by a pair of notches extending upwardly from the bottom of said jacket between said front panel and said rear panel.

7. A jacket, comprising:

a front panel including a bottom;

a rear panel joined to said front panel, said rear panel having side-by-side parts;

a zipper on said rear panel for releasably fastening together said side-by-side parts of said rear panel;

a pair of guide loops each being respectively secured to one of said side-by-side parts of said rear panel for receiving and supporting a handcuff retaining belt encircling said jacket;

a pair of tubular sleeves each having a bottom joined to and extending from said front panel and said rear panel for receiving the arms of a wearer;

said front panel includes an elevatable flap at the bottom thereof being separated from said rear panel by a pair of notches extending upwardly from the bottom of said jacket between said front panel and said rear panel;

said elevatable flap being provided with a first pair of openings remote from said rear panel for receiving the hands of a wearer projecting from the bottoms of said tubular sleeves, said first pair of openings being substantially adjacent with one another so that the hands of the wearer are, brought into substantially close proximity with one another between said elevatable flap and said rear panel so that handcuffs is worn thereon; and, said elevatable flap being provided with a second pair of openings located adjacent said first pair of openings for passage of said handcuff retaining belt into and through said jacket between said elevatable flap and said rear panel.

* * * * *